United States Patent [19]

Ilukowicz

[11] Patent Number: 4,498,270

[45] Date of Patent: Feb. 12, 1985

[54] SUPPORT FOR POSITIONING REINFORCING RODS OR MESH IN CONCRETE OR THE LIKE

[75] Inventor: Robert J. Ilukowicz, Port Jefferson, N.Y.

[73] Assignee: Preco Industries Limited, Plainview, N.Y.

[21] Appl. No.: 367,393

[22] Filed: Apr. 12, 1982

[51] Int. Cl.[3] ..... F04C 5/16

[52] U.S. Cl. ..... 52/685; 52/687; 52/686; 52/689

[58] Field of Search ..... 52/684, 685, 687, 688, 52/689, 686, 309.1, 169.1

[56] References Cited

U.S. PATENT DOCUMENTS

| | | | |
|---|---|---|---|
| 3,209,509 | 10/1965 | O'Callaghan, Jr. | 52/688 |
| 3,289,379 | 12/1966 | Watts | 52/689 |
| 3,348,347 | 10/1967 | Berry | 52/309.1 |
| 3,387,423 | 6/1968 | Andersen | 52/687 |
| 3,471,987 | 10/1969 | Yelsma | 52/689 |
| 3,693,310 | 9/1972 | Middleton | 52/685 |
| 3,788,025 | 1/1974 | Holmes | 52/687 |
| 3,830,032 | 8/1974 | Robb | 52/687 |
| 4,060,954 | 12/1977 | Liuzza | 52/309.1 |

FOREIGN PATENT DOCUMENTS

| | | | |
|---|---|---|---|
| 227969 | 5/1960 | Australia | 52/689 |
| 367966 | 4/1963 | Switzerland | 52/686 |

*Primary Examiner*—John E. Murtagh
*Assistant Examiner*—Kathryn L. Ford
*Attorney, Agent, or Firm*—Posnack, Roberts, Cohen & Spiecens

[57] ABSTRACT

A support is provided for reinforcing rods or mesh. The support includes a plate of substantially planar construction. A cruciform structure is provided beneath and supporting the plate. The cruciform structure includes a plurality of legs and tips depending from the legs. The tips are adapted to expose a relatively minimal part of the support with the support being embedded in a substance such as concrete. On top of the plate is provided a structure to limit movement of the rod or mesh transversely of the plate. Specifically pairs of pins toed in towards one another are employed or fins are employed with ramps thereon to restrain the movement of rods or mesh which are supported on the plate.

18 Claims, 11 Drawing Figures

FIG. 4
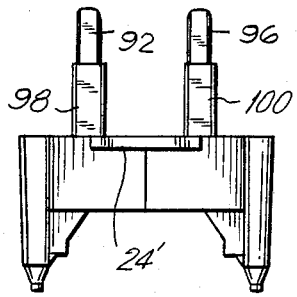
FIG. 5
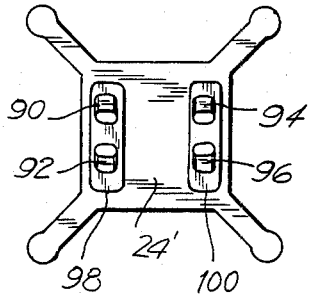
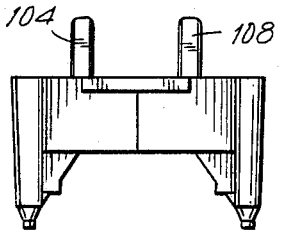
FIG. 6
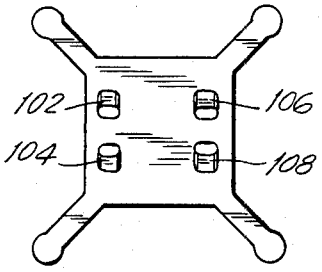
FIG. 7

FIG. 10
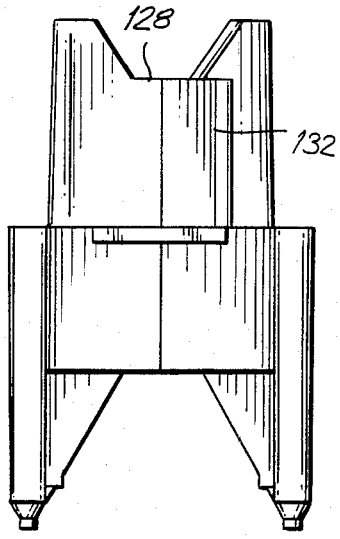
FIG. 8
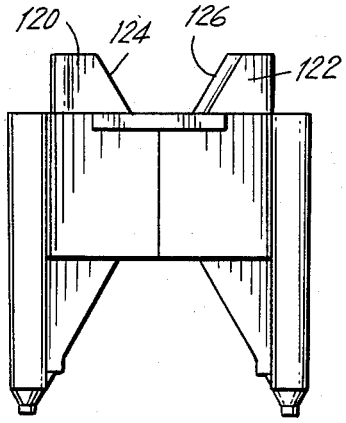
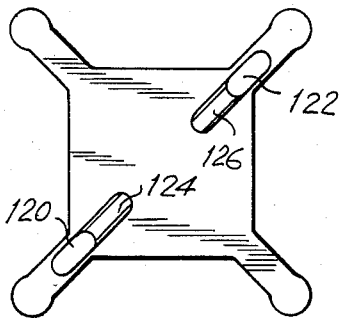
FIG. 9
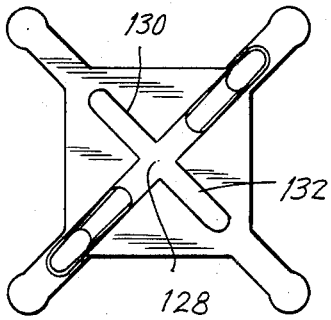
FIG. 11

SUPPORT FOR POSITIONING REINFORCING RODS OR MESH IN CONCRETE OR THE LIKE

FIELD OF INVENTION

This invention relates to structures for supporting reinforcing rods, bars or mesh or the like in concrete forms within which such reinforcing structures are intended to be located for purposes of being embedded in and reinforcing concrete or the like.

BACKGROUND OF INVENTION

As is stated in U.S. Pat. No. 3,530,634 (G. F. Adams), concrete is strong in compression but weak in tension and because it is likely to crack due to shrinkage and expansion and contraction from ambient temperature changes, it is advisable to embed steel reinforcing rods or bars or mesh in the concrete as the concrete is being cast. The resulting concrete and reinforcing structure is commonly known as reinforced concrete.

U.S. Pat. No. 3,530,634 furthermore indicates that there are various types of support brackets which find utility in supporting the reinforcing rods while the concrete is being poured so that the rods will be properly positioned within the concrete when it sets. A number of patents disclose such supports, such as, for example, U.S. Pat. Nos. 1,268,887; 1,841,699; 1,880,710; 3,788,025; and 4,085,559. In addition, for purposes of background information, reference may be made to German Pat. No. 2,228,969 and to British Pat. No. 904,766.

U.S. Pat. No. 1,268,887 shows a reinforcing device comprising a skeleton member having a plurality of ends which are thin, substantially flat and somewhat flexible. These ends are fashioned with cut-off portions having constricted communication to an edge of the skeleton member whereby the flexing of the material bordering the constricted cut-out area enables the insertion of an object fitted to the remainder of the cut-out area. This construction enables the installation of reinforcing devices or tie braces in concrete forms to be ultimately embedded in concrete constructions.

U.S. Pat. No. 1,841,699 reveals a bar support and spacer constructed of a single piece of wire which is fabricated to form a bar supporting part and a spacing part. The wire is bent to provide a pair of downwardly diverging legs with a horizontal foot which is exposed in the ultimately cast concrete.

D. H. Bitney in U.S. Pat. No. 1,880,710 reveals a reinforce support unit comprising a looped element having an arm which is straight and an arm which is angled and provides a base member. A cross piece is disposed transversely of the aforesaid arm and is provided with an upwardly facing loop adapted to receive a reinforce bar and support the same for being embedded in concrete which is cast thereabout.

S. Holmes in U.S. Pat. No. 3,788,025 discloses a chair support for reinforcing rods of the type supporting in right angular relationship two reinforcing rods used in the construction of concrete slabs. The chair has a lower arched base part and an upper rod supporting part integral with the base. The base is an arched structure with means providing lateral, longitudinal and vertical support and strength. The rod supporting part comprises two spaced arms the lower parts of which form a saddle for receiving one reinforcing rod and the upper part of each of which is formed by two spaced upstanding inwardly concave arms the upper ends of which are spaced to provide an opening through which a second reinforcing rod may be introduced.

U.S. Pat. No. 4,085,559 (R. Ilukowicz) discloses a hog slat reinforcing bar support which comprises a one-piece plastic body with spaced support portions for respective reinforcing bars. Each portion includes a surrounding wall with an opening through which the associated reinforcing bar can be inserted and held within the support portion. The portions may be connected by a connection piece with projecting members extending laterally from the body and defining a plurality of support points by which the body can be stabily supported in a hog slat form. The portions may also be supported on a structure in the shape of an A-frame.

British Pat. No. 904,766 reveals an X-shaped device at the extremities of which are provided receptacles for partially encircling reinforcing rods. The lowermost of the receptacles are provided with pins which present a substantially reduced contact with the floor of the form in which the concrete is to be cast.

SUMMARY OF THE INVENTION

It is an object of the invention to provide an improved support structure for supporting reinforcing rods, mesh and bars or the like in concrete forms in which concrete is to be cast with the idea in mind that the rod, bars, mesh or the like will be ultimately embedded in the cast concrete to add to the ultimate strength thereof.

It is another object of the invention to provide an improved chair construction for supporting mesh or reinforcing bars or rods in architectural concrete.

Still another object of the invention is to provide an improved support for reinforcing rods or bars or mesh for use in various types of concrete structures which are cast in situ and/or which are of built-up design or precast construction and which are all but invisible on the surface of the architectural concrete.

Still another object of the invention is to provide an improved chair support which is relatively strong while being lightweight and rust-proof.

Still another object of the invention is to provide an improved reinforcing rod or bar or mesh support which will ultimately accommodate various types of reinforcing structures.

In achieving the above and other objects of the invention there is provided a support for a reinforcing rod, bar or mesh which comprises a plate of at least substantially planar construction. A cruciform structure is provided beneath the plate to support the same. This cruciform structure includes a plurality of legs, preferably four in number, and tips depending from and adapted to support the legs and thereby the above-mentioned plate. The tips are adapted to expose a relatively minimal part of the support with the support embedded in a substance such as concrete being solidified about and reinforced by the rod, bar or mesh. A structure is provided atop the plate to limit movement of the rod, bar or mesh transversely of the plate.

In accordance with some preferred aspects of the invention, webs are supplied which couple the legs to the plate. These webs are preferably and generally triangular. Moreover, fillets may be supplied which are coupled to the webs. These fillets may couple webs which are located on a common diagonal.

In accordance with other aspects of the invention, triangular teeth may be provided in depending relationship from the aforesaid webs. These teeth will preferably have circular cross-sections, although they will be sawtooth in profile. The aforementioned legs will also have preferably circular cross-sections.

The above-mentioned tips, which depend from the legs, will be in accordance with the invention, preferably of inverted truncated conical shape. The cruciform structure may preferably be about 2–3 inches in breadth and the entire construction as noted to this point and hereinafter, will preferably be a monolithic construction of a suitable plastic.

To afford a means for restricting movement of the reinforcing structure there may be provided pairs of pins toed in towards one another and extending upwardly from the above-mentioned plate. These pins may be connected directly to the plate or may be spaced above the plate by a suitable vertical wall. Two pairs of the pins may be provided which are aligned in parallel relationship with one another and which define a channel for receiving the reinforcing structure. Alternatively, four pairs of the pins may be provided which are aligned in groups which are arranged perpendicularly of one another.

Alternatively to the above, the portion of the chair structure, which engages the reinforcing structure, may include a pair of fins extending upwardly from the above-mentioned plate and aligned in coplanar relationship. These fins may have facing ramps which define a channel for receiving the reinforcing structure.

The above and other objects, features and advantages of the invention will be found in the detailed description which follows hereinafter, as illustrated in the accompanying drawing.

BRIEF DESCRIPTION OF DRAWING

Figure 1:
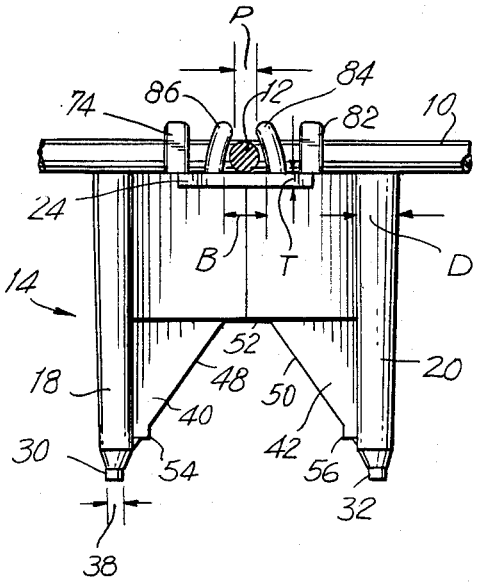
Figure 2:
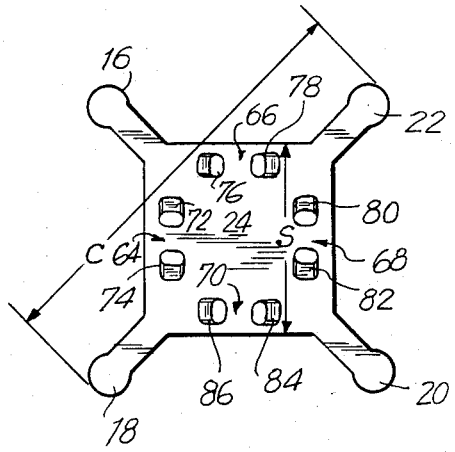
Figure 3:
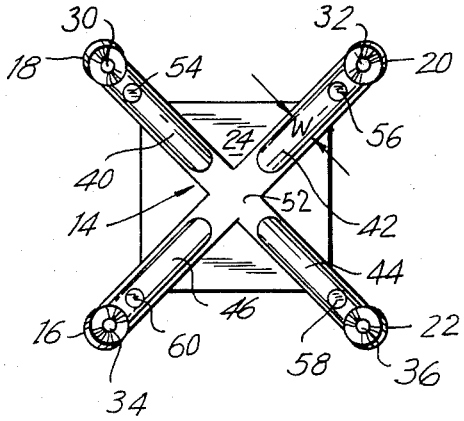

IN THE DRAWING:

FIG. 1 is a side view of a chair support provided in accordance with a preferred embodiment of the invention;

FIG. 2 is a top view of the chair support of FIG. 1;

FIG. 3 is a bottom view of the chair support of FIGS. 1 and 2;

FIG. 4 is a side view of a second embodiment of the invention;

FIG. 5 is a top view of the support of FIG. 4;

FIG. 6 is a side view of a third embodiment of the invention;

FIG. 7 is a top view of the support of FIG. 6;

FIG. 8 is a side view of a fourth embodiment of the invention;

FIG. 9 is a top view of the support of FIG. 8;

FIG. 10 is a side view of a fifth embodiment of the invention; and

FIG. 11 is a top view of the support of FIG. 10.

DETAILED DESCRIPTION

A typical use of the supports of the invention will find a plurality of such supports distributed in an open flat form adapted to receive concrete to be poured therein. Before the concrete is poured into the form, reinforcing rods or bars or mesh will be supported by the supports of the invention in a position spaced from the floor of the form. This will enable concrete to be poured in and around the reinforcing structure to embed the same therein, whereafter the concrete will be cast permanently incorporating into the body of the same the reinforcing structure as well as the supporting chairs therefor. It will be observed that in accordance with the invention some of the chairs thereof can be engaged on the mesh or on the reinforcing bars or rods before the same are moved into position in the concrete form. This is enabled by the fact that such supports of the invention may claspingly engage the reinforcing structure and be moved with the same into the concrete forms.

The chair support illustrated in FIGS. 1–3 constitutes one of the preferred forms of the supporting structure of the invention. In FIG. 1 the support is illustrated as supporting a mesh consisting of diagrammatically illustrated transverse wires 10 and 12. The support consists of a cruciform structure indicated generally at 14. This cruciform structure terminates outwardly in four vertical legs 16, 18, 20 and 22 of preferably circular cross-section.

The cruciform structure is located beneath and supports a plate 24 of at least substantially planar construction. The thickness of the plate is indicated at T and may be in the order of magnitude, for example, of 1/16th to $\frac{1}{8}$th of an inch. The plate is preferably of right quadrilateral structure and is moreover preferably square. The plate will preferably have a side length indicated at S which will be in the order of from $\frac{3}{4}$th to $1\frac{1}{2}$ inches.

Depending from the bottoms of each of the legs and coextensive therewith are the tips 30, 32, 34 and 36. These tips are preferably of inverted truncated conical shape and have a minimum diameter 38 at the lowermost portions thereof of about 1/64th to 1/16th of an inch. When the concrete is cast, only these tips will be exposed and these points of exposure will be well spaced and there will be minimal exposure of the supporting structure. Moreover, it will be obvious that this exposed portion of the structure will be rust-proof since the entire construction is preferably of a monolithic plastic structure. The plastic may be, for example, a high density polyethylene.

The construction may, moreover, comprise a plurality of webs such as indicated at 40, 42, 44 and 46. These webs couple the aforementioned legs to the plate 24. These webs are preferably triangular in shape having, for example, inclined lower edges illustrated, for example, at 48 and 50. The webs may have, for example, a thickness of about $\frac{1}{8}$th to $\frac{1}{4}$ of an inch such as indicated, for example, at W.

In addition to the aforementioned webs, the structure of the invention may incorporate fillets such as indicated at 52. These fillets extend between adjacent webs and function to connect the same.

Still further, the structure of the invention includes teeth such as indicated at 54 and 56, as well as at 58 and 60. These teeth are triangular in profile but have a circular cross-section as best viewed in FIG. 3. These teeth preferably have a diameter corresponding to the thickness of the corresponding webs and are therefore transversely coextensive with the same. The webs, fillets and teeth cooperate to distribute forces applied downwardly onto the plate 24 and distribute these forces into the concrete which is being poured or otherwise serve to render the cruciform structure cohesive in order to avoid a flattening of the chair support.

The aforementioned legs 16, 18, 20 and 22 are preferably of a diameter in the order of magnitude of about $\frac{1}{4}$ of an inch. These legs thus extend laterally outwardly of the associated webs to which they are affixed. The tops of the legs, webs and plate 24 are preferably coplanar and thus terminate in a common horizontal plane. The size of the cruciform structure embodying the above is such that it extends preferably in the order of magnitude of about 2 to 3 inches, as shown, by way of example, at C in FIG. 2

In the construction illustrated in FIGS. 1–3, the structure which engages the reinforcing structure is provided in the form of four pairs of upwardly extending pins included within the periphery of plate 24. These pairs are indicated generally at 64, 66, 68 and 70. Pair 64 includes pins 72 and 74, pair 66 includes pins 76 and 78, pair 68 includes pins 80 and 82, and pair 70 includes pins 84 and 86. Each pair of pins includes pins which are toed inwardly towards one another. Thus, for example, as best seen in FIG. 1, pins 84 and 86 are toed in and incline at an angle of, for example, 45 to 80 degrees. At the upper extremities thereof they are spaced apart in the order of magnitude of about $\frac{1}{8}$th of an inch, as indicated at P. At the lower extremities or bases thereof, they are spaced apart in the order of magnitude of about $\frac{1}{4}$ of an inch, as indicated, by way of example, at B.

The aforesaid pins are preferably such as to have a circular cross-section and may preferably have a diameter of about 1/16th to $\frac{1}{8}$th of an inch. They are monolithically formed with the plate 24 from which they directly extend. Pairs 66 and 70 are seen to define a common channel extending transversely of plate 24. These pins or pairs of pins are parallel with one another. Pairs of pins 64 and 68 define a channel which extends at right angles to the channel defined by pairs 66 and 70. Thus, while the pairs of pins 64 and 68 are parallel with one another, they may be regarded as extending generally perpendicularly of the pairs of pins 66 and 70.

The chair support illustrated in FIGS. 4 and 5 constitutes a variation of the construction described above relative to FIGS. 1–3. In this second embodiment of the invention, pairs of pins 90, 92 and 94, 96 are parallel with one another. They are spaced from the plate 24' by parallel walls 98 and 100 which define between them a channel for accommodating a reinforcing bar or rod. As in the embodiment of FIGS. 1–3, pins 90 and 92 are toed in toward one another, as are pins 94 and 96. They cooperatively define a channel extending transversely of the channel defined by walls 98 and 100, which extend vertically upwardly from the plate 24'. The walls 98 and 100 are partly within and partly without the periphery of plate 24'. In FIGS. 1–3, it will be seen that the pins are partly within and partly without the periphery of the plate 24. In the other respects described hereinabove, the construction of FIGS. 4 and 5 is similar to that of FIGS. 1–3 and requires no further explanations.

The construction in which the number of pairs of pins is reduced need not be limited to the use of the spaced walls 98 and 100 of FIGS. 4 and 5. Thus such pairs of pins may also be mounted directly on the associated horizontal plate as indicated in the form of pins 102, 104 and 106,108. These pins have their respective bases directly on the associated plate, but otherwise perform the functions indicated hereinabove with respect to FIGS. 1–5. It will be appreciated that each of these embodiments of the invention provide for a clasping of the reinforcing structure such that these chairs may be mounted on the reinforcing structure in clasping engagement therewith before the reinforcing structure is placed into position in the associated concrete form.

The web, fillet and cruciform structures associated with the above-mentioned plate may be utilized in other forms, as, for example, illustrated in FIGS. 8 and 9. Therein appear a pair of upwardly extending fins 120 and 122. These fins have facing ramps 124 and 126 which serve to receive and accommodate the reinforcing structure. The fins are coextensive with the associated webs and cruciform structure and are thus arranged on a common diagonal relative to the associated plate. The channel defined between these ramps 124 and 126 defines a channel for accommodating the reinforcing bar, rod or mesh, as aforesaid.

As illustrated in FIGS. 10 and 11, the aforesaid fins may be coupled by a fillet such as indicated at 128. This fillet may be regarded as a wall spacing the fins above the associated plate. FIGS. 10 and 11 moreover illustrate that a further wall may be arranged in perpendicular relationship to the fillet 128. Two such walls are illustrated in FIG. 11 in coplanar relationship at 130 and 132. In the embodiments illustrated in FIGS. 8 and 9 and 10 and 11, respectively, it will appear that the fins extend from within to the outside of the periphery of the associated plate. It will also appear that the associated plate is supported by a cruciform structure inclusive of webs and fillets as well as legs, all as have been described hereinabove.

There will now be obvious to those skilled in the art many modifications and variations of the structure set forth hereinabove. These modifications and variations will not depart from the scope of the invention, if defined by the following claims.

What is claimed is:

1. A support for a reinforcing rod, bar or mesh, said support comprising a plate of at least substantially planar construction, a cruciform structure beneath and supporting said plate, a plurality of legs on said cruciform structure and tips depending from and adapted to support said legs and thereby said plate, said tips being adapted to expose a relatively minimal part of said support with said support being embedded in a substance being solidified about and reinforced by said rod, bar or mesh, means on said plate to limit movement of the rod, bar or mesh transversely of said plate, said tips being of inverted truncated conical shape, said means including at least two spaced pairs of pins toed in towards each other and extending upwardly from said plate, said cruciform structure comprising intersecting portions integrated with said plate to extend radially thereof, said intersecting portions having upper surfaces disposed substantially in a common plane with one another and with the upper surface of the plate to form a substantially common upper surface for said support, said intersecting portions intersecting beneath said plate and having outer ends which are integral with said legs to couple said legs with said plate, said intersecting portions including fillet portions, tapered webs depending from said intersection portions and interconnected by said fillet portions, said webs tapering towards said tips, and triangular teeth projecting from said tapered webs at a tapered surface thereof whereby to independently engage and become embedded in said solidified substance to distribute forces thereto.

2. A support as claimed in claim 1, wherein said cruciform structure includes four said legs.

3. A support as claimed in claim 1, wherein said webs are generally triangular.

4. A support as claimed in claim 1 wherein said teeth have circular cross-sections.

5. A support as claimed in claim 4, wherein said legs have circular cross-sections.

6. A support as claimed in claim 1, wherein the truncated conical shape has a minimum diameter of about 1/64th to 1/16th of an inch.

7. A support as claimed in claim 6, wherein said plate is substantially a square having sides about $\frac{3}{4}$th to $1\frac{1}{2}$ inches in lengths.

8. A support as claimed in claim 7, wherein said webs are about $\frac{1}{8}$th to $\frac{1}{4}$ inch thick.

9. A support as claimed in claim 8, wherein the cruciform structure is about 2–3 inches in breadth.

10. A support as claimed in claim 1, wherein the pins are connected directly to said plate.

11. A support as claimed in claim 1 comprising a wall between said pins and plate, said wall extending vertically upwards from the plate and including an upper end from which said pins extend.

12. A support as claimed in claim 1 comprising two pairs of said pins including the first said pair, said two pairs of pins being aligned in parallel relation and defining a channel for receiving said rod, bar or mesh.

13. A support as claimed in claim 1 comprising four pairs of said pins including the first said pair, two of said pairs being aligned in parallel and the other two of said pairs being aligned in parallel with each other, but perpendicularly with respect to the first two said pairs of pins, each two pairs defining a channel, the channels being perpendicularly related.

14. A support as claimed in claim 1, wherein all of said pins are included within the periphery of said plate.

15. A support as claimed in claim 1, wherein said pins slope at an angle of from about 45–80 degrees.

16. A support as claimed in claim 1, wherein said pins include bases spaced apart in the order of magnitude of about $\frac{1}{4}$ of an inch and upper extremities spaced apart in the order of magnitude of about $\frac{1}{8}$th of an inch.

17. A support as claimed in claim 1, wherein the pins have a circular cross-section and a diameter of about 1/16th to $\frac{1}{8}$th of an inch.

18. A support as claimed in claim 1, wherein said support is a monolithic structure of plastic.

* * * * *